US005927542A

United States Patent [19]

Johnston et al.

[11] Patent Number: 5,927,542

[45] Date of Patent: Jul. 27, 1999

[54] DISPENSING APPARATUS

[75] Inventors: Craig Johnston; Niall O'Sullivan; Oliver Hood, all of Dublin, Ireland

[73] Assignee: Johnston Research & Development, Shannon, Ireland

[21] Appl. No.: 08/836,736

[22] PCT Filed: Sep. 9, 1995

[86] PCT No.: PCT/IE95/00040

§ 371 Date: Sep. 25, 1997

§ 102(e) Date: Sep. 25, 1997

[87] PCT Pub. No.: WO96/06412

PCT Pub. Date: Feb. 29, 1996

[30] Foreign Application Priority Data

| | | | |
|---|---|---|---|
| Aug. 19, 1994 | [IE] | Ireland | S940656 |
| May 23, 1995 | [IE] | Ireland | S950375 |

[51] Int. Cl.[6] ..... G07F 11/00

[52] U.S. Cl. ..... 221/6; 221/17

[58] Field of Search ..... 221/2, 3, 6, 7, 221/9, 13, 17, 103, 108

[56] References Cited

FOREIGN PATENT DOCUMENTS

| | | |
|---|---|---|
| 340420 | 3/1989 | European Pat. Off. . |
| 1536533 | 12/1978 | United Kingdom . |
| 2068915 | 8/1981 | United Kingdom . |

*Primary Examiner*—Kenneth Noland
*Attorney, Agent, or Firm*—Baker & Davis

[57] ABSTRACT

A dispensing apparatus comprises a try-like housing having recesses in an upper surface each for accommodating an item to be dispense. A non-return mechanism is located in the housing adjacent to each recess and has a member movable between a first position wherein the member is retracted to a position substantially flush with the recess sidewall and a second position (as seen in the figure) wherein the member projects into the recess to prevent re-insertion of an item. The movable member is retained in the first position by an item accommodated in the recess and is spring-biased to assume the second position when the item is removed. A microswitch is responsive to the movement of the member to signal when the member moves from the first to the second position and thus when an item is removed from the recess.

6 Claims, 10 Drawing Sheets

DISPENSING APPARATUS

BACKGROUND OF THE INVENTION

This invention relates to an apparatus for dispensing items, in particular a dispensing apparatus which permits the removal of an item to be registered electronically. In the preferred embodiment the invention relates to refrigerators located in hotel rooms.

SUMMARY OF THE INVENTION

According to the present invention there is provided a dispensing apparatus comprising means for accommodating an item to be dispensed, a non-return mechanism for preventing replacement of an item removed from the accommodating means, and an electrical component having an electrical characteristic which undergoes a measurable change when an item is removed from the accommodating means.

In the preferred embodiments the accommodating means comprises a housing having at least one recess in an upper surface thereof defining a receptacle for accommodating a part of an item to be dispensed and the non-return mechanism is located within the housing adjacent the recess and has a member movable between a reset position wherein the member projects into the recess through an aperture in a sidewall of the recess and a set position wherein the member is retracted to a position substantially flush with such sidewall. The movable member is retained in the set position by an item accommodated in the recess and assumes the reset position when the item is removed. The electrical component is responsive to the movement of the member to provide the measurable change when the member moves from the set to the reset position.

Preferably the housing is in the form of a tray slidably mounted in a refrigerated cabinet contained several such trays disposed one above the other.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
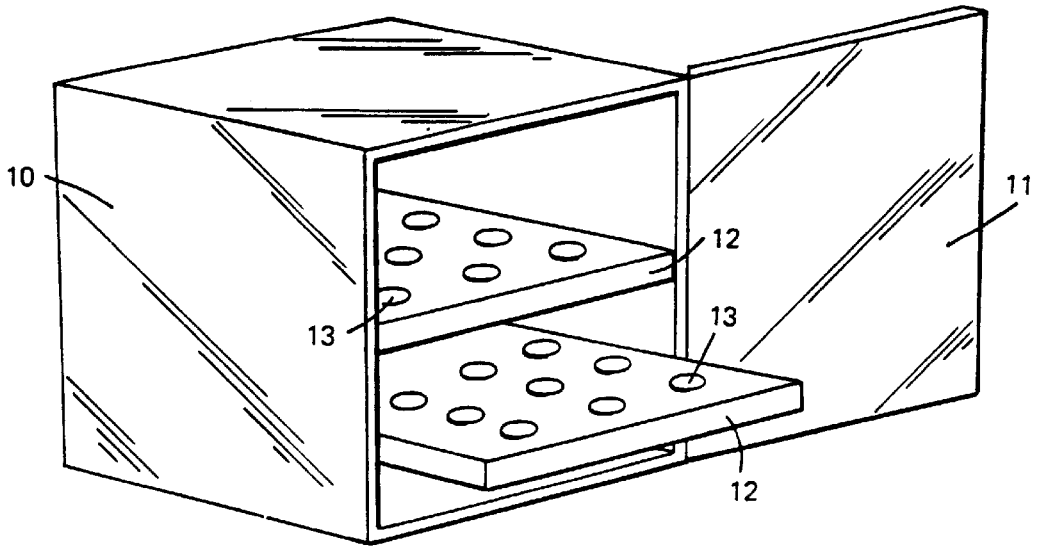
FIG. 1 is a perspective view of a refrigerator embodying the invention.

In FIG. 1, a refrigerator according to an embodiment of the invention has an outer insulated cabinet 10 with a front-opening door 11. Refrigeration equipment (not shown) is provided to refrigerate the interior of the cabinet in conventional manner. Within the cabinet there are a plurality of substantially horizontal trays 12. Each tray 12 is mounted in any suitable manner for horizontal sliding movement in the cabinet 10 so as to be capable of being partially withdrawn from the interior of the cabinet 10 through the front opening. This is shown for the lower of the two cabinets in FIG. 1. In its top surface each tray 12 has a plurality of receptacles 13 each for accommodating a respective one of a plurality of items to be dispensed (in FIG. 1 the receptacles are shown unoccupied).

Figure 2:
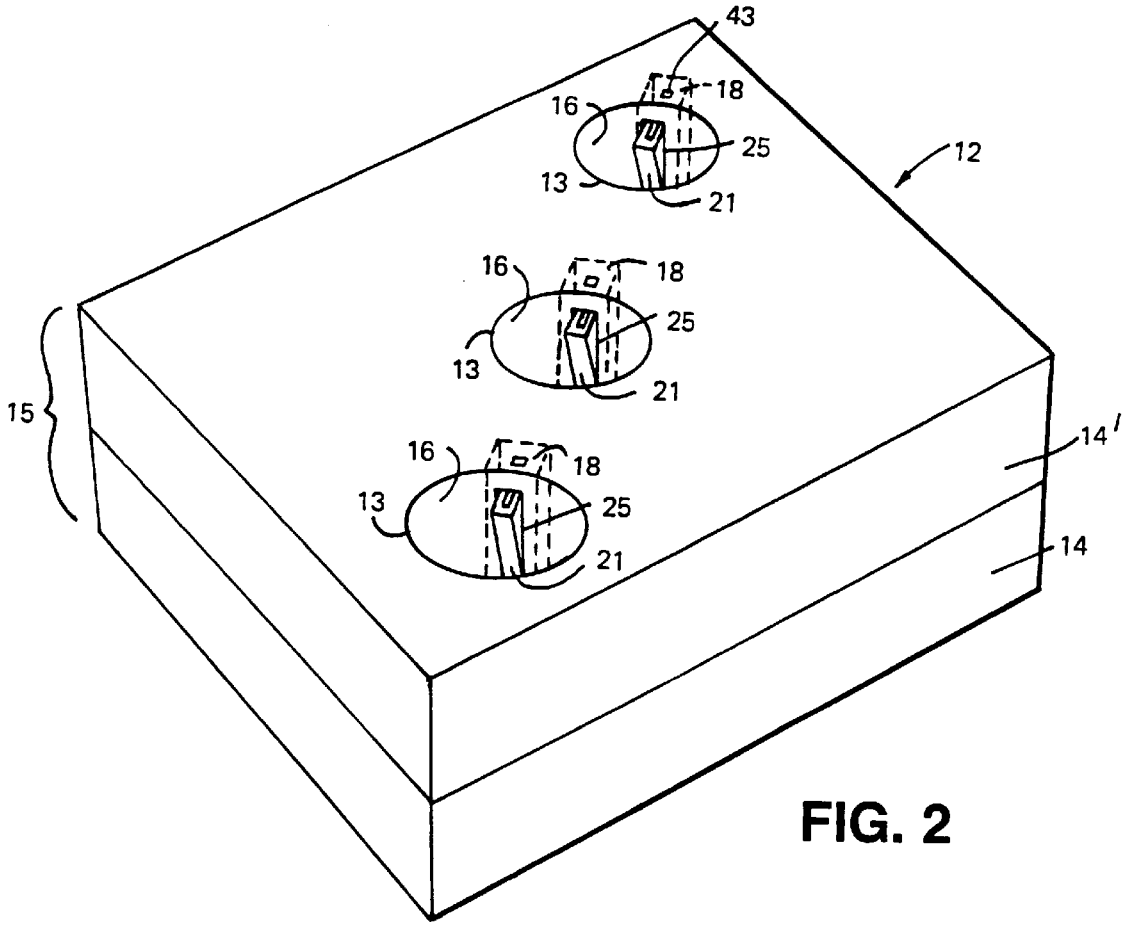
FIG. 2 is a perspective view of one of the trays from the refrigerator of FIG. 1.
Figure 3:
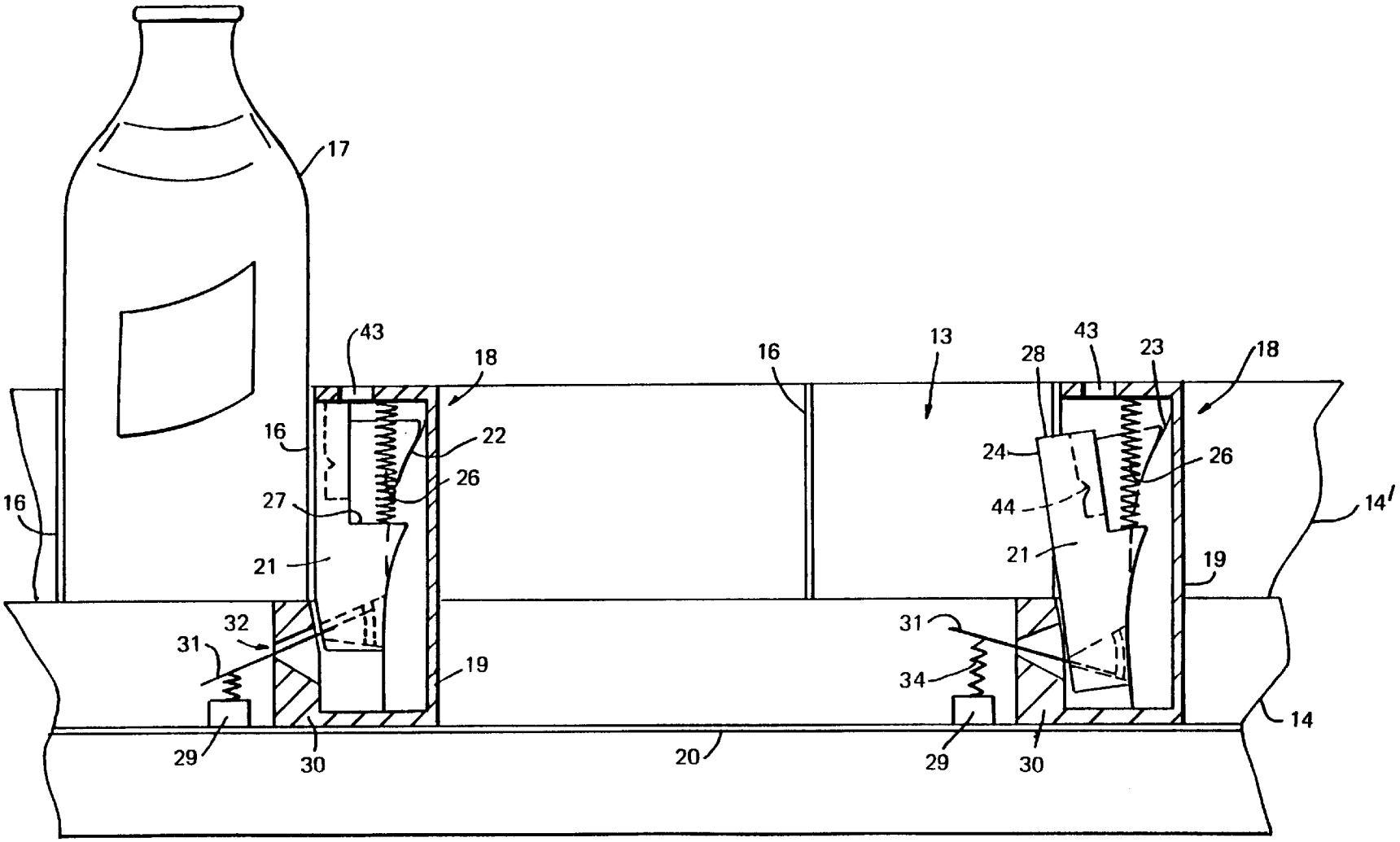
FIG. 3 is a cross-sectional view through part of the tray.
Figure 4:
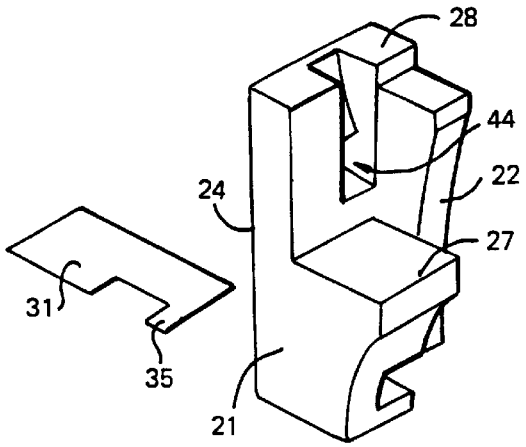
FIG. 4 is a perspective view of the slider block and paddle forming part of the non-return mechanism associated with each aperture in the tray.
Figure 5:
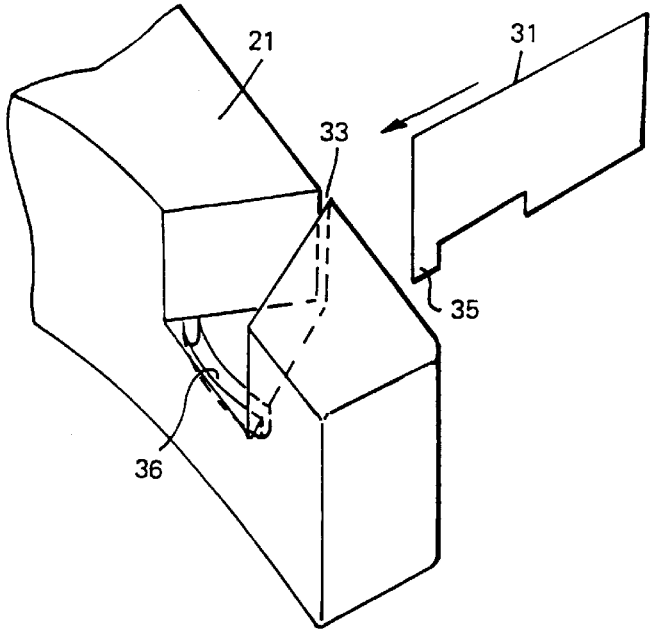
FIG. 5 is a perspective view of the bottom end of the slider block shown in FIG. 4.

Turning now to FIGS. 2 to 5, the tray 12 has a rectangular base 14 and an overlying cover 14' together constituting a shallow rectangular housing 15. The receptacles 13 (of which only three are shown in FIG. 2) are formed as recesses in the upper surface of the housing 15. Each receptacle has solid sidewalls 16 and is designed to accommodate a part of an item to be dispensed, such as the lower half of a bottle 17 as shown in FIG. 3. In particular, each receptacle has a substantially constant cross-section substantially the same as the cross-section of the part of the item to be accommodated therein, such that the item fits snugly within the receptacle with substantially no gap between the sidewalls 16 and the surface of the item.

A respective non-return mechanism 18 is located within the housing 15 immediately adjacent each receptacle 13, for preventing an item from being returned to its receptacle after it has been removed. The mechanism 18 comprises a housing 19, which will be referred to hereafter as a shell to avoid confusion with the housing 15. The shell 19, whose upper surface is flush with and effectively forms the upper surface of the housing 15 at that point, sits on a printed circuit board (PCB) 20 located within the base 14. The shell 19 is generally open facing the receptacle 13 and contains a slider block 21.

The block 21 has a concave bearing surface 22 which can slide against a convex bearing surface 23 formed at the rear of the shell 19, such that the block 21 can slide vertically within the housing from a set position at the top of the shell 19 as shown at the left of FIG. 3 to a reset position at the bottom of the shell 19 as shown at the right of FIG. 3. During such sliding movement the block 21 also rotates so that its front face 24, which is initially flush with the sidewalls 16 of the receptacle 13, projects into the interior of the receptacle through an aperture 25 formed in the sidewalls 16 immediately in front of the block 21. During such sliding the block 21 is constrained substantially against lateral movement, that is to say movement in the direction perpendicular to the plane of FIG. 3, by the lateral walls of the shell 19 whose internal surfaces are parallel and spaced apart by substantially the width of the block 21.

A spring 26 is held in compression between the top of the shell 19 and a ledge 27 formed on the block 21. This spring 26 resiliently biases the block 21 towards the reset position shown at the right hand side of FIG. 3. In use of the apparatus, the block 21 is held in the set position against the bias of the spring 26, using a device which will be described later with reference to FIG. 6, to permit an item such as the bottle 17 to be inserted into the respective receptacle 13. When the item is fully inserted the block 21 is released. However, the presence of the item in the receptacle 13 retains the block 21 in the set position.

When the item is removed from the receptacle 13, the block 21 is released and, under the influence of the spring 26, it moves down to the reset position. In this position the front face 24 of the block 21 projects into the receptacle 13, so that the top surface 28 of the block 21 forms a stop which prevents the item being re-inserted into the receptacle. Because there is substantially no gap between the sidewall 16 and the external surface of the item attempted to be re-inserted into the receptacle, it is not possible to hold the block 21 in the reset position from within the receptacle while the item is re-inserted. However, the block may be returned to and held in the set position by service personnel wishing to re-stock the tray by using the special device to be described with reference to FIG. 6.

In order to permit the removal of an item from a receptacle 13 to be registered electronically, a respective microswitch 29 is located on the PCB 20 immediately in front of each shell 19. The shell 19 has a low wall 30 at the front. A flat paddle 31 passes through a narrow horizontal slot 32 in the wall 30 and also through a narrow horizontal slot 33 near the bottom of the block 21, and the end of the paddle 31 outside the shell 19 is joined to the microswitch 29 by a light spring 34. Therefore, as the block 21 slides from the set to the reset position the paddle will "see-saw" about a fulcrum point constituted by the lower edge of the slot 32. As seen in the figures, behind each narrow slot 32 and 33 the aperture in the wall 30 and the block 21 widens in triangular fashion to provide sufficient room for the movement of the paddle 31. The movement of the paddle is guided by having a tooth 35 (FIG. 5) which engages in and moves back and forth along an arcuate slot 36 in one side of the aperture behind the narrow slot 33.

The microswitch 29 opens and closes according to the position of the paddle 31, and will be closed (or open) when the block 21 is in the set position and open (or closed) when the block 21 is in the reset position. The state of the microswitch 29 can be monitored by circuitry on the PCB 20, such that removal of an item from the tray can be detected. This information can then be sent to a central billing system of the hotel for automatic billing of the customer, and for this purpose the PCB 20 may be connected to external circuitry by flexible cables from each tray 12. Of course, means other than a microswitch can be used to register the removal of an item from the associated receptacle. Any electrical component having an electrical characteristic which undergoes a measurable change when an item is removed from the receptacle can be used.

Figure 6:
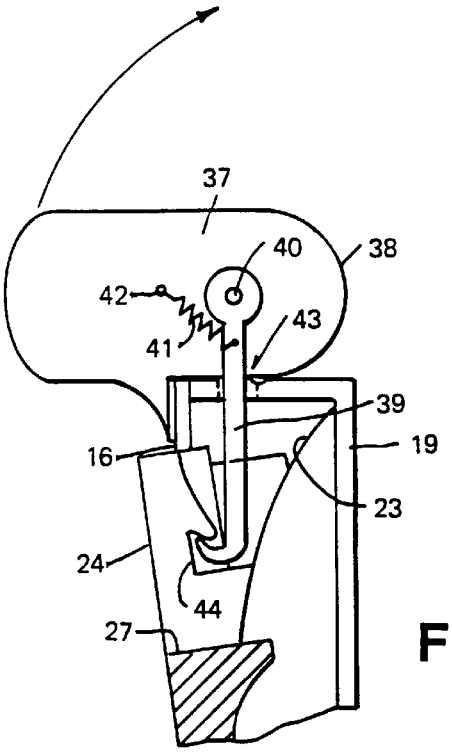
FIG. 6 shows a device which may to used to set the non-return mechanism.

FIG. 6 shows a device which can be used to set the mechanism 18 after removal of an item from the receptacle 13. The device comprises a handle 37 having an elliptically curved surface 38 at one end and a hook 39 pivoted to the handle at 40 near the curved end. A tension spring 41 is connected between the hook 39 and the handle 37 so that when the hook projects directly away from the handle the spring 41 passes over the pivot point 40. Thus the handle has two stable states, where the hook is on opposite sides respectively of the notional line passing through the pivot point 40 and the point 42 where the spring is attached to the handle.

Initially, with the handle in the state shown in FIG. 6, the handle is used to guide the hook into a small aperture 43 in the top of the shell 19 and the handle is brought to the position shown in FIG. 6 against the top of the shell 19. Since the hook 39 is urged by the spring 41 in a clockwise direction as seen in FIG. 6 it will be urged into engagement with a recess 44 behind the front face 24 of the block 21.

Now the handle 37 is rotated clockwise through 90 degrees to a position extending directly away from the top of the shell 19, causing the hook 39 to lift the block 21 to the set position. This allows an item such as the bottle 17 to be inserted into the receptacle. The elliptically curved surface 38 provides the lifting action.

Finally, the handle is rotated further to a position where the hook 39 is urged by the spring 41 in an anti-clockwise direction, causing the hook to disengage the recess 44 and allowing it to be withdrawn from the aperture 43.

Figure 7:
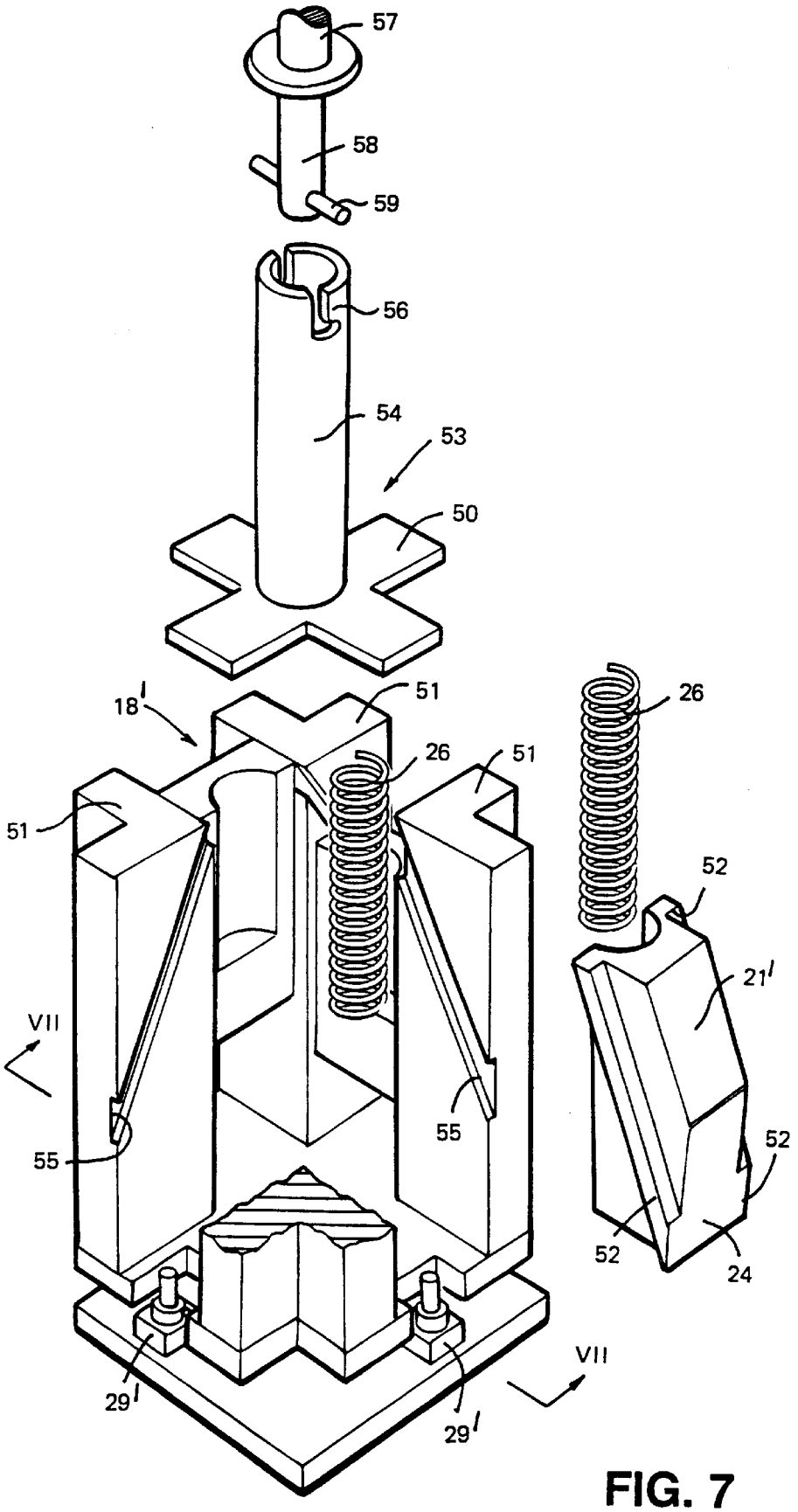
FIG. 7 is an exploded perspective view of a second embodiment of a dispensing apparatus according to the invention.
Figure 8:
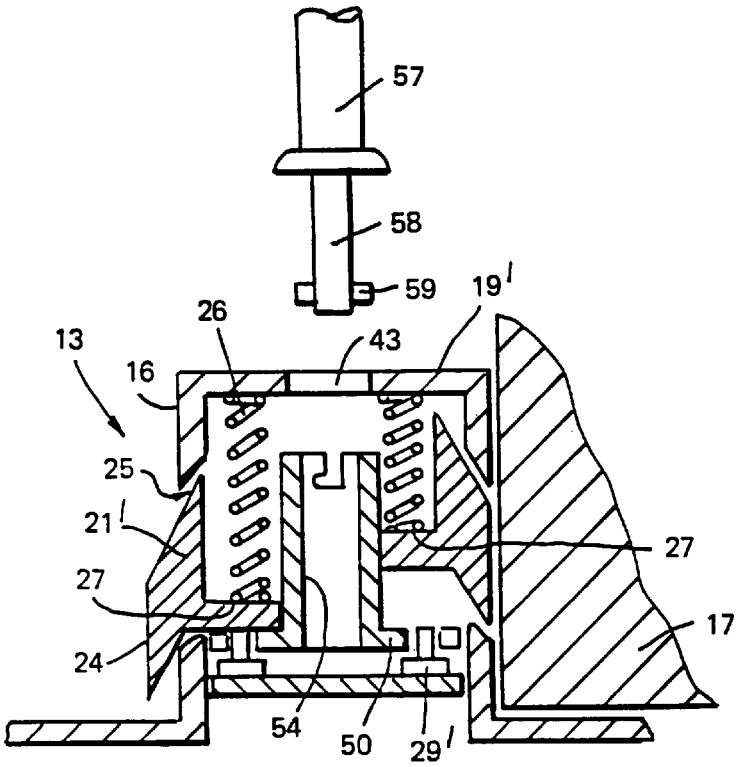
FIG. 8 is a cross-sectional elevation along the line VII—VII of FIG. 7.
Figure 9:
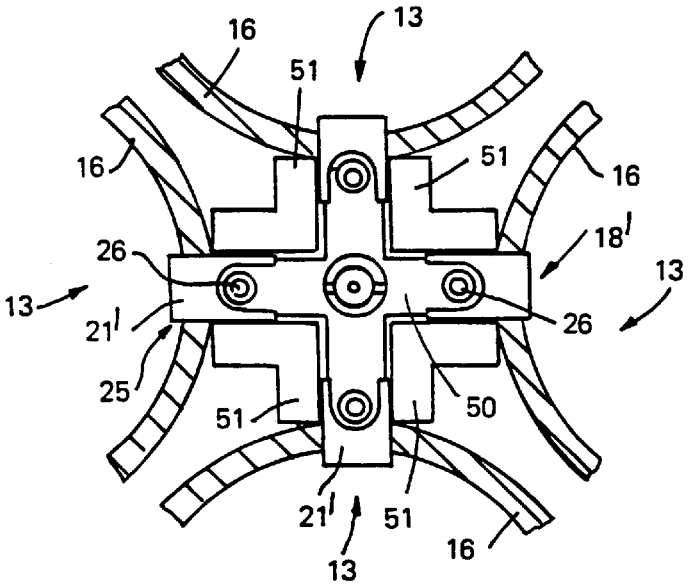
FIG. 9 is a plan view of the dispensing apparatus of FIG. 7.

In a second embodiment of the invention, FIGS. 7 to 9, receptacles 13, having circular sidewalls 16, are grouped in sets of four in the housing 15. Each receptacle 13 has an associated non-return mechanism 18' located in the space between each set of four sidewalls 16, FIG. 9. The mechanisms 18' are disposed at 90 degree spacing about the centre of the space. Each mechanism 18' includes a slider block 21'. Each slider block 21' is constrained against lateral movement by two walls 51 which lie one on each side of the slider block 21'. Adjacent lateral walls 51 from respective non-return mechanisms 18' are formed as an integral right-angled piece.

A pair of inclined rails 52 are formed on opposite sides of each slider block and run from the top of the rear face of the block remote from the receptacle 13 down towards the front face 24 of the block. Each rail 52 is located in a similarly inclined groove 55 formed in a respective lateral wall 51. Thus, each block 21' is slidable from a set position in which the front face 24 of the block is flush with the sidewall 16 to a reset position in which it extends through an aperture 25 in the sidewall 16, shown at the left in FIG. 8. To facilitate easier movement of the block 21', a bearing (not shown) can be inserted to fit between each rail 52 and its respective groove 55.

A spring 26 is held in compression between the upper surface 19' of the housing 15 and a ledge 27 formed on the rear face of the block 21'. The spring 26 resiliently biases the block 21' towards the reset position.

In the second,embodiment, the mechanism for setting the non-return mechanisms 18' comprises two parts. The first part 53 includes a flat cross-piece 50 with a tubular member 54 extending upwardly from its centre. The cross-piece 50 is fitted so that each arm of the cross-piece 50 lies under a respective slider block 21' and between its respective lateral walls 51. A pair of L-shaped slots 56 are formed adjacent the top of the tube 54.

The second part 57 comprises a handle which is insertable through a small aperture 43 formed in the upper surface 19' of the housing 15. The handle comprises a shaft 58 having two diametrically opposite studs 59 adjacent its end which are engageable with the slots 56. Thus, when the handle is inserted into the aperture 43 and twisted the studs 59 positively engage the slots 56 in a bayonet fit, allowing the operator may draw the handle upwards with the first part 53 entrained. This causes the arms of the cross-piece 50 to lift any slider blocks in the reset position back to the set position. The handle may be held in this position by any number of conventional means, for example using clamps or ratchets, so that the operator is free to place a bottle 17 in any empty receptacles 13 before subsequently releasing the handle and allowing the springs 26 to urge the slider blocks 21' against bottles 17 located in respective receptacles 13.

Movement of the slider blocks 21' between the set and reset positions is detected by a micro-switch 29' located directly under each slider block 21'. Each micro-switch 29' is monitored by circuitry on a suitably located PCB as before.

It will be seen that the mechanism for setting the non-return mechanisms 18' can be made as secure as may be required, for example, by adapting the top of the tube 54 and the end of the handle to include a key mechanism. It will also be seen that the second embodiment can be varied to include groups of any number of receptacles 13 spaced apart appropriately. For example, five receptacles could be spaced at 72 degrees apart with a five-arm cross-piece 50 used to reset each respective mechanism 18'.

Figure 10:
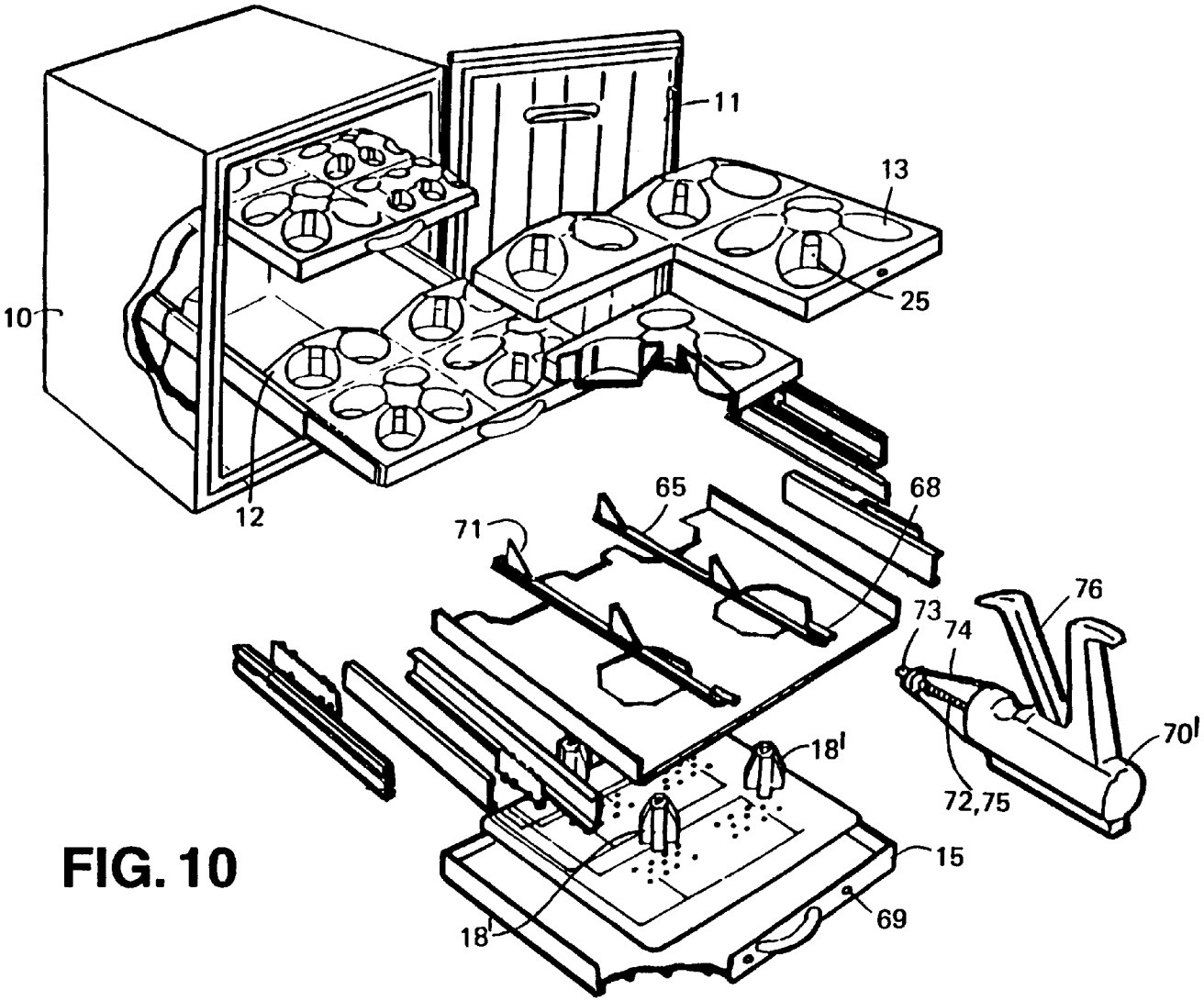
FIG. 10 is an exploded view of a refrigerator according to a third embodiment of the invention.

In a third embodiment of the invention, FIG. 10, receptacles 13 having circular sidewalls 16 are again grouped adjacent one another in sets of four, there being four such groups in each tray providing sixteen receptacles 13. The third embodiment differs from the second embodiment in that the mechanism for setting the non-return mechanisms 18' operates by urging the slider blocks 21' into the set position from below rather than drawing the slider blocks 21' into the set position from above.

The first part 53 of the mechanism for setting the non-return mechanisms 18' in the second embodiment is replaced in the third embodiment with a first part 53' comprising a flat cross-piece 50, as in the second embodiment, from the centre of which a solid cylindrical member 54' extends upwardly. The cross-piece 50 is again fitted so that each arm of the cross-piece 50 lies under a respective slider block 21' and between its respective lateral walls 51. The cylindrical member 54' protrudes from an aperture 63 in the upper surface 19" covering the mechanisms 18' to ensure that the first part 53' is constrained to move vertically between the set and the reset positions.

Figure 11:
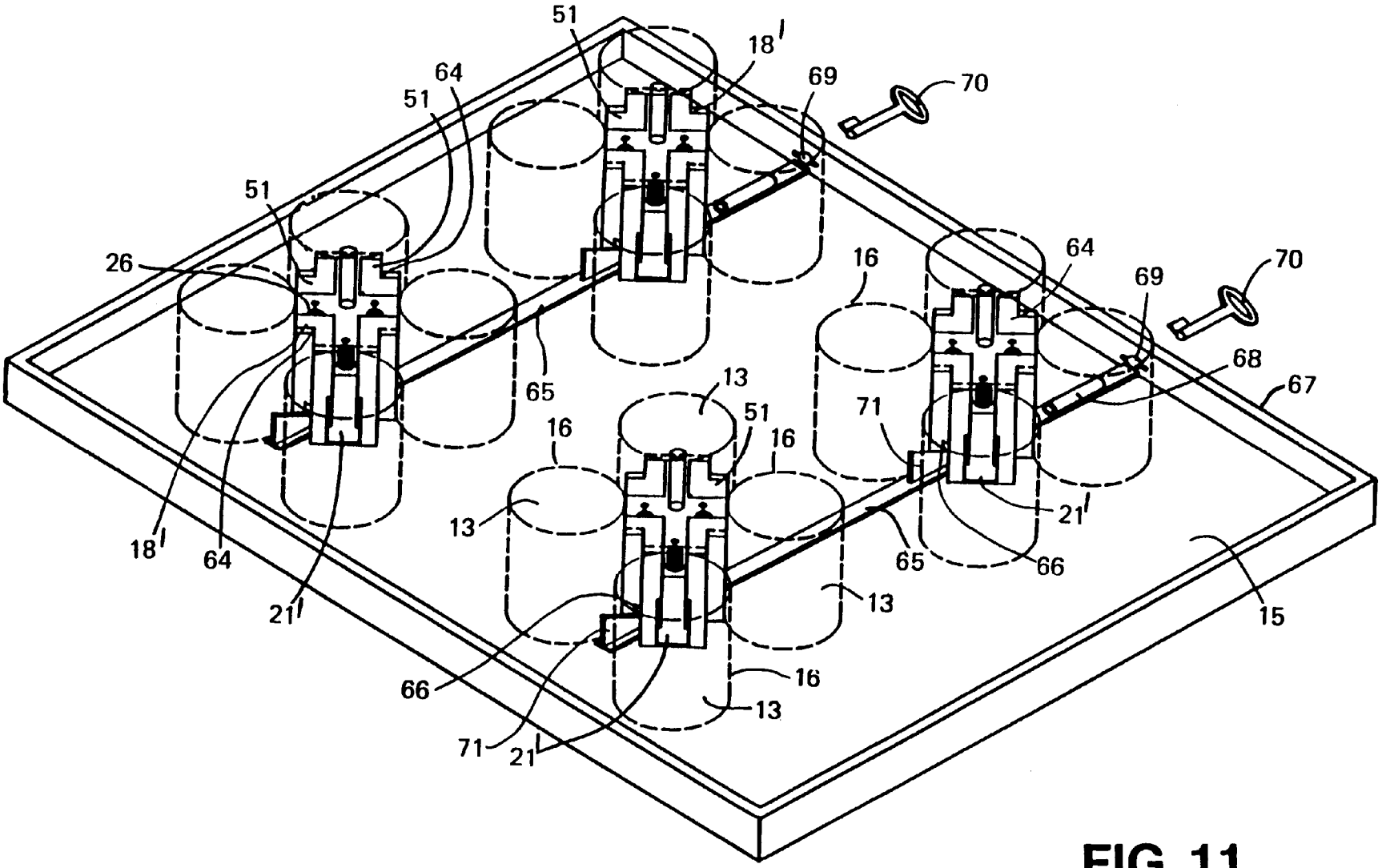
FIG. 11 is an internal perspective view of a tray from the refrigerator of FIG. 10.
Figure 12:
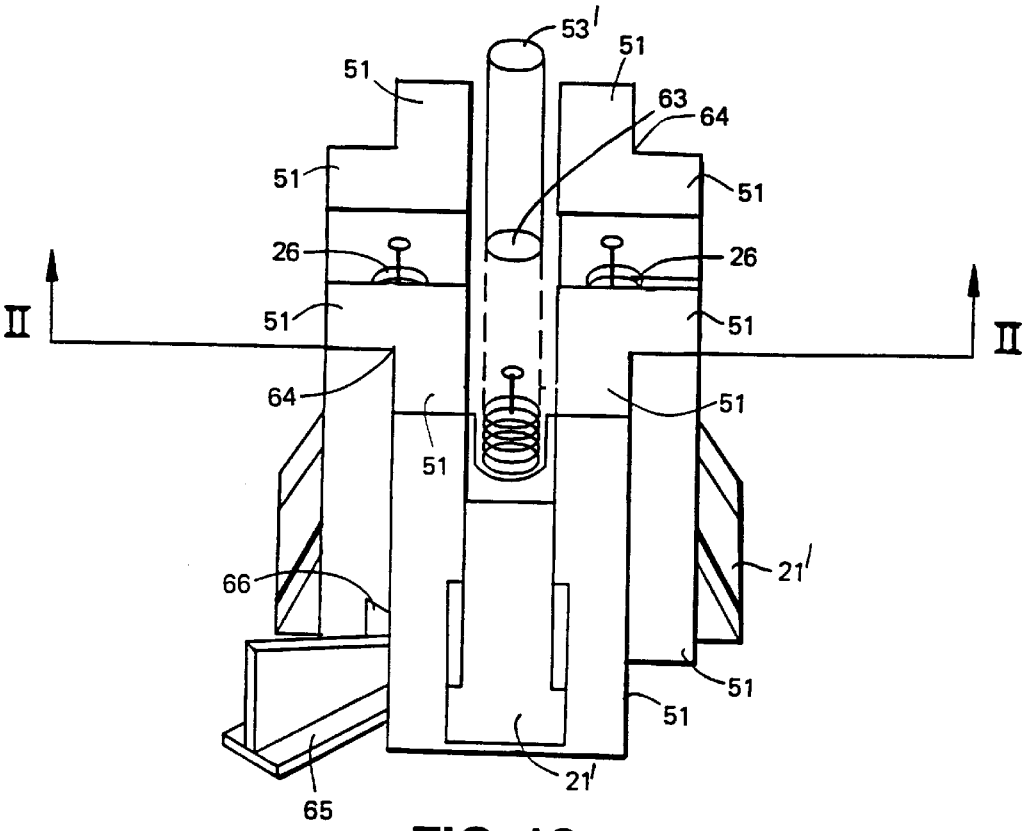
FIG. 12 is a detailed view of a group of non-return mechanisms of FIG. 11.
Figure 13:
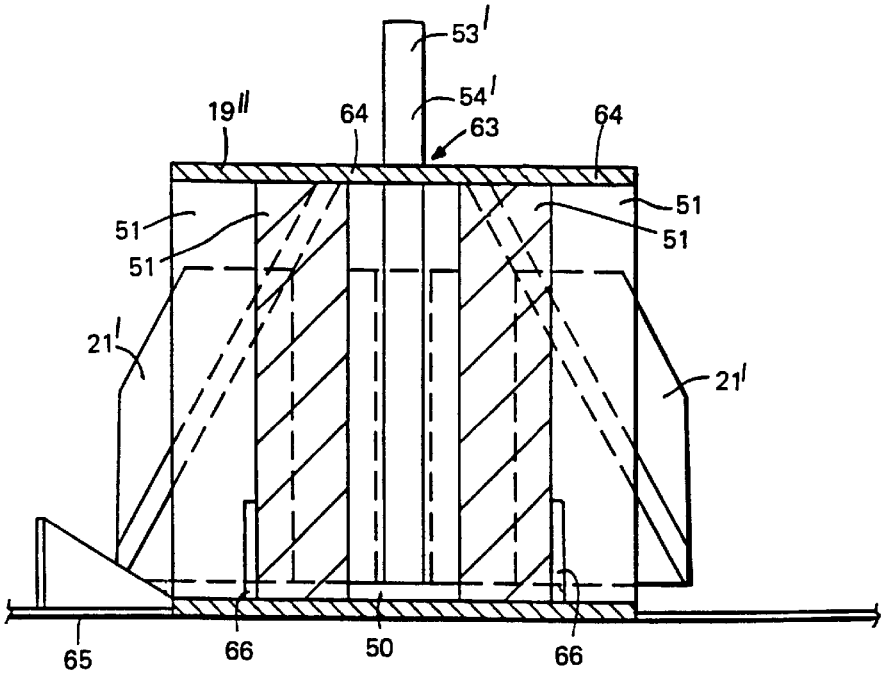
FIG. 13 is a cross-sectional elevation along the line II—II of FIG. 12.

The second part of the mechanism comprises an elongate strip 65 which asses under the cross-piece, FIG. 11. The strip 65 passes through slots 66 formed at the bases of diagonally opposite corners 64 of adjoining lateral walls 51. In the third embodiment there are two parallel strips 65 each passing under and being operatively associated with two groups of mechanisms 18'. The strip 65 extends as far as a sidewall 67 of the housing 15. At the end of the strip 65 a tubular barrel 68 is formed. Slots (not shown) are formed at the free end of the end of the barrel 68.

A key 70 (FIG. 11) is insertable through an aperture 69 formed in the side 67 of the housing in register with the end of the barrel 68. The key 70 includes a shaft which is adapted to engage the slots in the barrel 68 when the key 70 is inserted through the aperture 69 and twisted. A pair of cams 71 are formed on each strip 65 and each is disposed adjacent the slot 66 on that side of a respective group of mechanisms 18' which is furthest away from the aperture 69. Each cam 71 is triangular in shape and projects to a height equal to the vertical displacement of the slider blocks 21' between the set and reset positions.

Thus, when the key 70 is inserted into the aperture 69 and twisted, the operator may retract the key with the strip 65 entrained to draw the strip 65 towards the side 67. This causes the cams 71 to be drawn under the respective cross-pieces 50 thus lifting the cross-pieces 50 which in turn lift any slider blocks in the reset position back to the set position. The key 70 may be held in this position by conventional means to allow the operator is free to place a bottle or other item in any empty receptacles 13 before subsequently releasing the key and allowing the springs 26 to urge the slider blocks 21' against items located in respective receptacles 13.

Alternatively, the key 70 can be replaced with a conventional spring loaded ratchet gun 70', FIG. 10. The gun includes a shaft 72 which extends from the front of the gun and which is insertable through the aperture 69. The distal end 73 of the shaft 72 is adapted to engage and entrain the barrel 68. A plate 74 extends from the front of the gun. The distal end of the plate is bent to form a flap in which a hole is formed and through which the end 73 of the shaft 72 passes. A spring 75 is located over the length of the shaft 72 between the front of the gun and the flap, with the spring tending to extend the shaft from the front of the gun. In use, the end 73 of the shaft is inserted in the aperture 69, with the flap bearing against the sidewall 67. Squeezing the gun trigger 76 causes the shaft 72 to draw the entrained strip 65 towards the sidewall 67, thus setting the non-return mechanisms 18'.

Secure operation of the non-return mechanism 18' of the third embodiment relies on the difficulty posed in re-inserting a bottle into a receptacle 13 while manually attempting to hold the slider block 21' in the set position. If a bottle or any other item is not a snug fit with its respective receptacle 16, then it may be possible to set the non-return mechanism without using the key 70 or gun 70' (although it will be realised that the associated electronic circuitry described previously can always detect removal of the bottle and bill a user appropriately).

Figure 14:
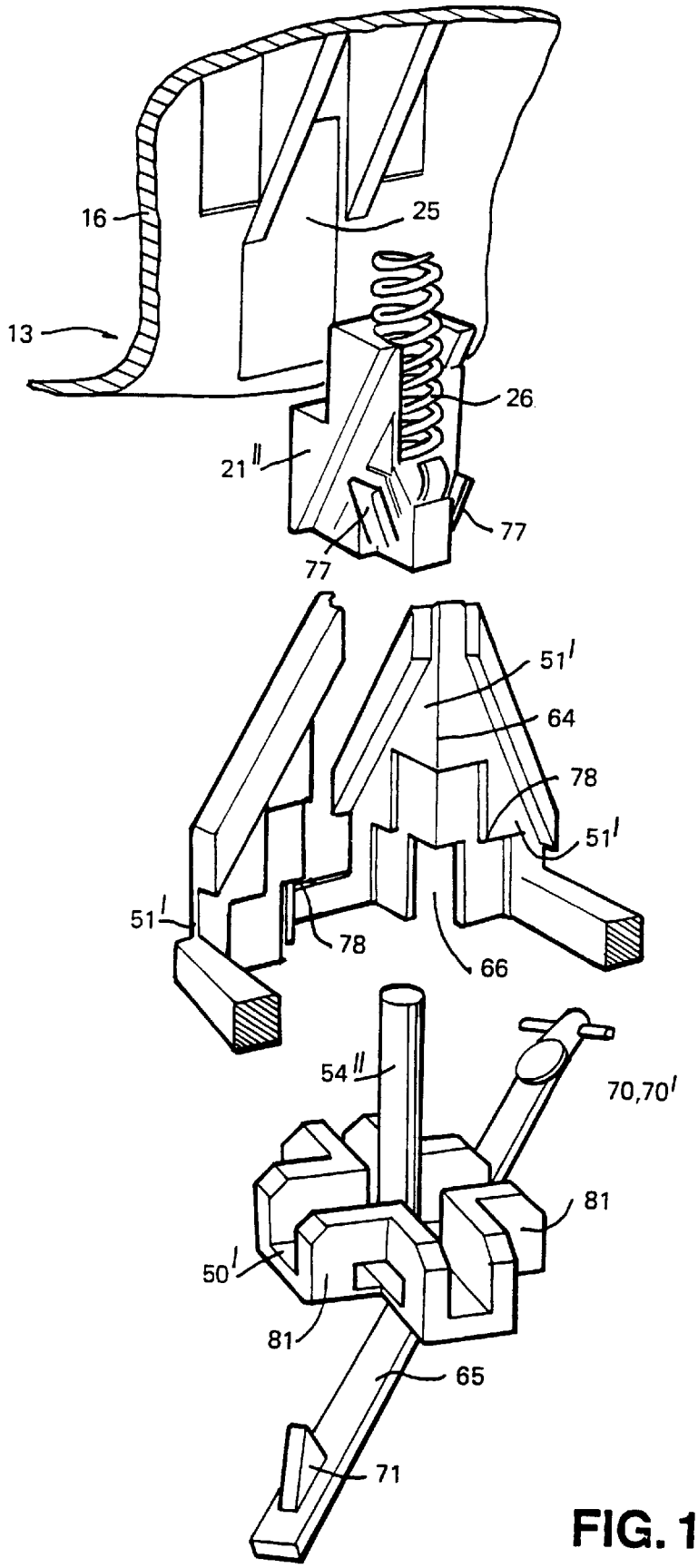
FIG. 14 is an exploded view of a dispensing apparatus according to a fourth embodiment of the invention.

This problem is mitigated in a fourth embodiment of the invention, FIG. 14, where a slider block 21" is maintained more securely in the reset position by being adapted to positively engage the lateral walls 51 ' when in the reset position.

Figure 15A:
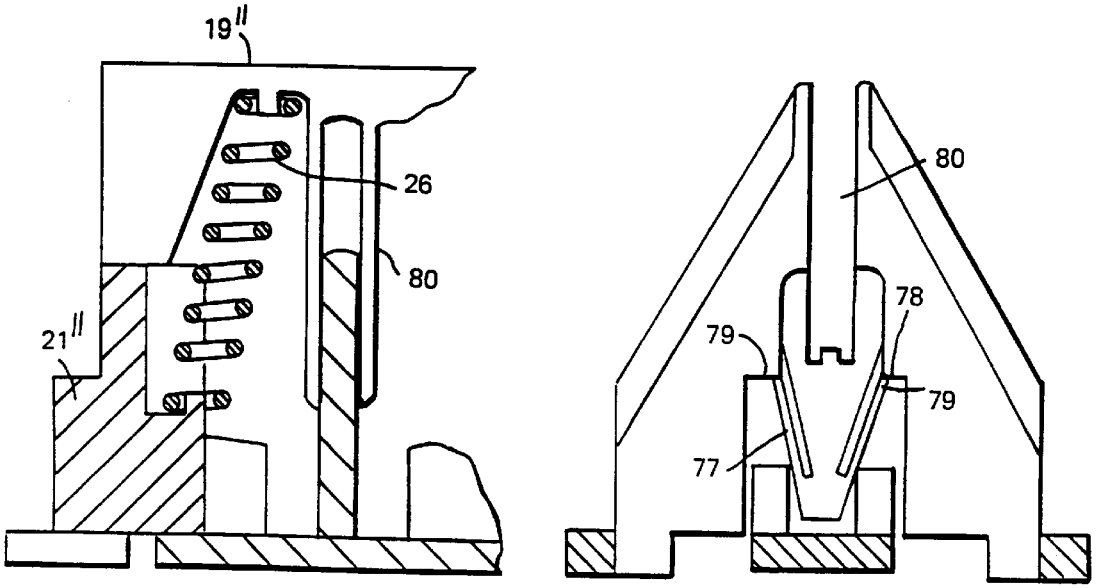
FIGS. 15(*a*) and 15(*b*) show elevation views of the dispensing apparatus of FIG. 14 in its reset and set positions respectively.
Figure 15B:
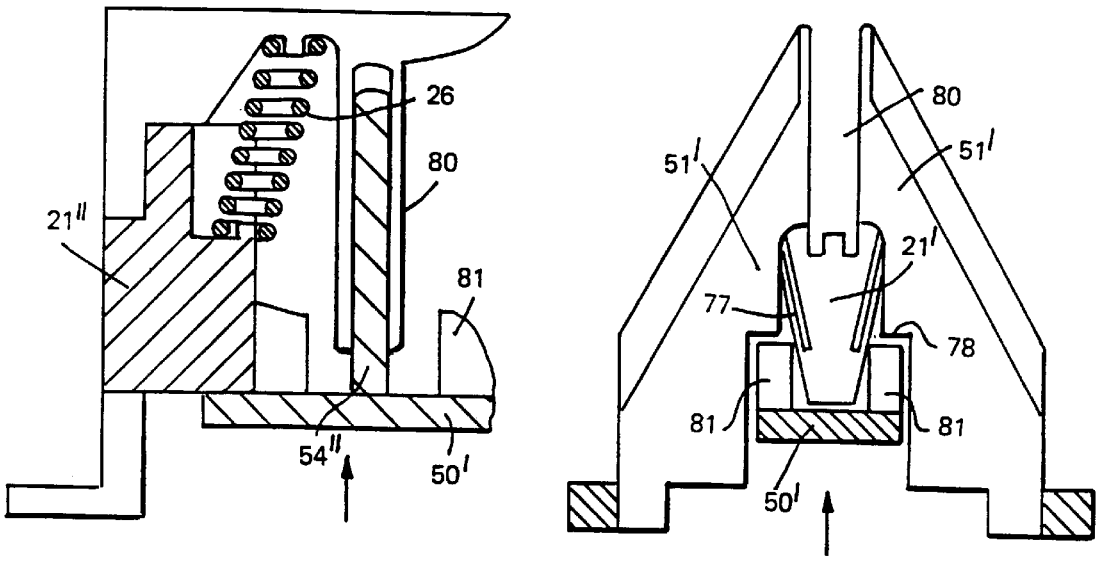

A pair of resilient arms 77 project upwardly and outwardly from opposite sides at the base of each slider block 21" towards respective lateral walls 51'. A step 78 is formed in each lateral wall 51' thus forming a narrowed neck 90 between the upper portions of opposite walls 51'. When a slider block 21" is held in the set position, FIG. 15(*b*), the arms 77 are held in compression in the neck 90 between the upper portions of the lateral walls 51'. However, when a bottle or other item is removed from a receptacle 13 the slider block 21" drops as before so that the arms 77 can expand outwardly towards the more widely spaced lower portions of the walls 51', FIG. 15(*a*). In this position the distal ends 79 of the arms 77 will come to bear against the underside of respective steps 78 in the lateral walls 51' if any unauthorised lifting of slider blocks 21" into the set position is attempted, thereby preventing such unauthorised lifting.

To allow the slider block 21" to be lifted back into the set position, the cross-piece 50 of the third embodiment is replaced in this embodiment with a cross-piece 50' along whose radiating edges side walls 81 project upwardly. The distance between opposing side walls 81 is approximately equal to the width of the neck 90 between the upper portions of opposing lateral walls 51'. The slider block 21" sits between opposing sidewalls 81. It will be seen that when the cross-piece 51" is moved upwardly when following the inclined profile of the triangular cam 71 being drawn underneath it, the sidewalls 81 will cause the arms 77 to be compressed against the side of the slider block 21". Thus, their ends 79 no longer bear against the steps 78, and the slider block 21" can be lifted into the set position, FIG. 15(*b*).

In the fourth embodiment, the member 54", which is shorter than the member 54' of the third embodiment, slides within a blind sleeve 80 which projects downwardly from underneath the upper surface 19" of the housing 15. The sleeve 80 thus constrains the member 54" to move vertically without the need for the member 54" to protrude from the upper surface 19", thus ensuring more secure operation of the non-return mechanism.

We claim:

1. A dispensing apparatus comprising a housing having at least one recess in an upper surface thereof defining a receptacle for accommodating a part of an item to be dispensed, a non-return mechanism located within the housing adjacent to the recess for preventing replacement of an item removed form the recess, the non-return mechanism comprising a member slidable downwardly from a set position wherein the member is retracted into an aperture in a sidewall of the recess to a reset position wherein a part of the member projects into the recess through the aperture in the sidewall, the slidable member being retained in the set position by an item accommodated in the recess and assuming the reset position when the item is removed by resilient biasing means which urges the slidable member to the reset position, and an electrical component having an electrical characteristic which undergoes a measurable change when the member moves from the set to the reset position, wherein the slidable member is adapted for cooperation with a lifting means for returning the slidable member to the reset position against the resilient biasing means, the lifting means being operable from outside the housing through an aperture in the housing which is small compared with the recess opening, wherein the slidable member is constrained against lateral movement by a pair of walls one on either side, at least one said wall having a downward facing surface and the slidable member having at least one outwardly extending resilient member which engages under the said surface in the reset position, and wherein the lifting means acts to compress the resilient member against the slidable member to permit the slidable member to be lifted to the set position.

2. A dispensing apparatus as claimed in claims 1, wherein the lifting means includes a lifting member extending beneath the slidable member, the lifting member being liftable to return the slidable member to its set position, and means operative through said small aperture for lifting the lifting member.

3. A dispensing apparatus as claimed in claim 2, wherein the small aperture is provided in one side of the housing and the lifting means includes a cam member extending below the lifting member for lifting the latter upon lateral movement of the cam member, the cam member being engageable through said small aperture for effecting said lateral movement thereof.

4. A dispensing apparatus as claimed in claim 1, wherein the housing has at least one group of recesses each with an associated non-return mechanism, and wherein the lifting member extends beneath all the movable members of a group of non-return mechanisms such that the lifting means operates in common on all the non-return mechanisms of the group.

5. A dispensing apparatus as claimed in claim 1, wherein the electrical component is a microswitch.

6. A dispensing apparatus as claimed in claim 1, wherein the housing is in the form of a tray slidably mounted in a refrigerated cabinet.

* * * * *

UNITED STATES PATENT AND TRADEMARK OFFICE

CERTIFICATE OF CORRECTION

PATENT NO. : 5,927,542

DATED : July 27, 1999

INVENTOR(S) : Craig Johnston; Niall O'Sullivan, Oliver Hood

It is certified that error appears in the above-identified patent and that said Letters Patent is hereby corrected as shown below:

Claim 1, line 19 - "form" should be --from--

Signed and Sealed this
First Day of February, 2000

*Attest:*

*Attesting Officer*

Q. TODD DICKINSON

*Acting Commissioner of Patents and Trademarks*